US006508588B1

(12) United States Patent
Meyer et al.

(10) Patent No.: US 6,508,588 B1
(45) Date of Patent: Jan. 21, 2003

(54) PLASTIC FILM BAG STACK WITH CORNER HOLES SEPARATED BY PERFORATIONS FROM A FLAP HAVING STACKING OPENINGS

(75) Inventors: Armin Meyer, Köln (DE); Jakob Schneider, Niederkassel (DE); Bert Wuits, Troisdorf (DE); Ingo Schübel, Nederkassel (DE)

(73) Assignee: Jumo Maschinenbau GmbH, Niederkassel-Mondorf (DE)

( * ) Notice: Subject to any disclaimer, the term of this patent is extended or adjusted under 35 U.S.C. 154(b) by 0 days.

(21) Appl. No.: 09/522,216

(22) Filed: Mar. 9, 2000

Related U.S. Application Data

(60) Provisional application No. 60/124,756, filed on Mar. 17, 1999.

(30) Foreign Application Priority Data

| | | |
|---|---|---|
| Mar. 17, 1999 | (DE) | 199 12 019 |
| Apr. 16, 1999 | (DE) | 199 17 284 |
| Jul. 28, 1999 | (DE) | 199 35 064 |
| Jul. 28, 1999 | (DE) | 199 35 065 |

(51) Int. Cl.[7] ..... B65D 33/00; B65D 33/14
(52) U.S. Cl. ..... 383/37; 383/9; 206/554
(58) Field of Search ..... 383/9, 37, 35; 206/554

(56) References Cited

U.S. PATENT DOCUMENTS

| | | | | |
|---|---|---|---|---|
| 3,184,055 A | * | 5/1965 | Davis et al. | 206/554 X |
| 4,759,639 A | * | 7/1988 | DeMatteis | 383/9 X |
| 5,226,858 A | * | 7/1993 | Snowdon | 206/554 X |
| 5,248,040 A | * | 9/1993 | DeMatteis et al. | 206/554 |
| 5,348,399 A | * | 9/1994 | DeMatteis | 206/554 X |
| 5,497,884 A | * | 3/1996 | DeMatteis et al. | 206/554 |

FOREIGN PATENT DOCUMENTS

| | | | | |
|---|---|---|---|---|
| DE | 1958690 | * | 5/1971 | 206/554 |
| DE | 3703757 | * | 8/1988 | 383/37 |
| FR | 1464148 | * | 11/1966 | 206/554 |

* cited by examiner

*Primary Examiner*—Jes F. Pascua
(74) *Attorney, Agent, or Firm*—Herbert Dubno

(57) ABSTRACT

Stack consisting of a multiplicity of bags which are connected to one another and are made of plastic film, in particular vending machine bags, and also process and apparatus for producing and filling bags of this type The invention concerns a stack consisting of a multiplicity of bags which are connected to one another and are made of plastic film, in particular vending machine bags, and also a process and apparatus for producing and filling bags of this type which, for the purpose of simple production and handling when filling with a product, such as, for example, a loaf of bread or the like, have perforation lines (9, 9') which run at an angle with respect to the filling opening (6) in order to form corner sections (11) with interconnecting points (12) provided in them, and which, when filling, can be severed cleanly from the bag stack and taken for packaging with a nice-looking exterior.

4 Claims, 8 Drawing Sheets

PLASTIC FILM BAG STACK WITH CORNER HOLES SEPARATED BY PERFORATIONS FROM A FLAP HAVING STACKING OPENINGS

CROSS REFERENCE TO RELATED APPLICATIONS

This application is a nonprovisional application based upon provisional application No. 60/124,756 filed Mar. 17, 1999.

FIELD OF THE INVENTION

The invention relates to a stack consisting of a multiplicity of bags which are connected to one another and are made of plastic film, in particular vending machine bags, having a filling opening and a flap which is on one side and has stack openings and at least one initial cutting point.

BACKGROUND OF THE INVENTION

In continuous production of bags, it is generally known to gather together in a collecting apparatus a specified number of bags to form so-called bag stacks. A suitable collecting apparatus is, for example, a stud-type stack conveying device having a stud-type stack conveyor chain which moves in the horizontal direction and receives the severed bags on stacking studs. The stack openings, whose distance apart corresponds to the distances between the stacking studs on the stud-type stack conveyor chain, are punched into each bag. During the production of the bag stacks it is furthermore known to fix said stacks by means of a wicket, specifically in such a manner that the limbs of the wicket are guided through the stack openings in the flap part of the bags. For this purpose, either the bag stacks are lifted off the stacking studs of the stud-type stack conveying device and placed with the bags, which now rest loosely on one another, onto the limbs of the wicket, or the limbs of the wicket are inserted into the hollow groove-like recesses in the stacking studs of the stud-type stacking conveyor chain and the particular bag stack is removed in this manner.

In order to stabilize the bag stacks and to protect them against being damaged by the ends of the wickets as a plurality of bag stacks are being packaged together, the bag stacks are laid between a front and rear cover sheet and are additionally secured by securing washers or rubber stoppers placed on the limbs of the wickets. All of these procedures are generally carried out manually by an operator.

Apart from the considerable outlay on auxiliary materials, it can be quite difficult to package and transport bag stacks of this type because of the unwieldy wickets.

Considerable disadvantages also arise during the packing procedure, i.e. when filling a bag with a product, for example with a loaf of bread or the like. During the filling procedure, the wicket, which is inserted through the punched-out stack openings, serves to fasten the bag stacks in the packaging machine, for example an automatic packaging machine. Since during the packing procedure the inserted product, for example a loaf of bread, is drawn off together with the bag surrounding it, it follows that the filled bag is conveyed linearly to a sealing device. The linear drawing off of the bag with the inserted product not only requires a bag which is precisely formed in terms of dimensions, but since there is a sudden initial tearing of the initial cutting point, which is conventionally located between the stack openings and the front edge of the flap, a frayed appearance results. The "frayed" edge region of the flap not only makes the bag look unsightly, but the flap surface is no longer readily suitable for securely attaching sealing elements, such as sticky labels or the like, and/or as a surface to print on or hold information.

Finally, after all of the bags are filled, the wickets have, if appropriate, to be transported back again to the manufacturer, i.e. to the producer of the bags, sorted according to size and, if appropriate, processed so that they can be reused.

OBJECTS OF THE INVENTION

The object of the invention is to provide a bag stack of the type mentioned at the beginning which can be handled, in particular packed and filled, substantially more simply, and, moreover, is distinguished by having an attractive exterior.

Another object is to provide a process by means of which interconnected bags, in particular vending machine bags, can be produced in a simple manner, with a good appearance in the edge region, and can be filled conveniently and neatly.

Furthermore, it is an object to provide an apparatus for producing and filling interconnected bags without complex auxiliary aids.

SUMMARY OF THE INVENTION

This object is achieved with regard to the product by the initial cutting point being formed as a tear-off perforation by perforation lines which in each case run at an angle with respect to the filling opening and delimit a corner section, and by at least one interconnecting point interconnecting the bags in the stack being arranged in each corner section.

A stack formed in such a way can be produced in a simple manner, conveniently transported and just as easily filled. The wickets which have hitherto been required can be completely dispensed with. It is possible, in particular, to organize the product and further handling of the bags substantially more cost-effectively, since the costs and, if appropriate the transporting of the wickets to and from between the packer and the manufacturer are omitted. It is merely necessary in the packing region to separate the topmost bag in each case rapidly and reliably from the bag stack and in so doing to hold the bag in such an opening position that the product (loaf of bread) can be inserted in a trouble-free manner into the bag. In the case of a filling procedure to be handled in accordance with the process according to the invention, this can be achieved by, in order to fill the topmost bag in each case of the bag stack, holding the bag at least in the region of its filling opening and/or of the flap, in such an opening position that the perforation between the corner sections and the flap is inevitably at least partially torn open and the bag is thereby at least partially detached from the interconnection in the stack.

Preferably the tearing open of the perforation takes place before the product to be packaged is inserted into the bag. This enables an exact tearing off along the perforation lines to be ensured in a simple manner.

The tearing open of the perforation by means of the opening procedure can be exactly regulated, namely by the configuration of the perforation lines, in particular their angular position and/or strength and/or their continuous or shortened extent between the side wall and the front edge of the flap, and the opening procedure during the filling of a bag being coordinated with each other.

Furthermore, this manner of proceeding makes it possible for the opening procedure to cause the perforation between the secured corner sections and the flap to be torn open, and also to cause the bag, which is detached from the bag stack, to be held in the opening position. In this manner, two functions are solved by one procedure, namely firstly the tearing open of the perforation, and secondly the securing of the bag during the packaging procedure.

If the aim is to obtain exact tearing off, particular attention has to be paid, among other things, also to the securing and interconnecting of the bags and of the bag stack. A particularly favorable solution is produced if the interconnections provided in the corner sections are designed as interconnecting holes, and the bag stack is suspended and/or held via these interconnected suspension opening during filling of the bags.

When the bag stack is suspended in this way, it is possible, in principle, to dispense with particularly large punched holes as suspension openings, as have hitherto been necessary for the wickets, in the remaining flap. However, in order to be able to collect the bags in a collecting device during the production process, the stack openings are either produced by pin holes, or else cross recesses are punched into the flap in order to form the stack openings.

With regard to the apparatus, the holding of the opened bag and the tearing off therefore from the bag stack in the filling station can be achieved in a particularly simple manner if an expanding device can be moved into a tear-off position effecting the only and at least partial severing of the tear-off perforation of the bag to be filled. The tear-off position can preferably correspond to the opening position which is necessary in order to insert a product or a loaf of bread. In contrast to the previous functions of an expanding apparatus, which merely had the task of forming the bag opening approximately corresponding to the shape and dimensions of the product to be packaged, the current expending device has two additional functions, namely firstly to secure the bag during the packaging procedure, and secondly to undertake the opening movement in such a manner that the expanding elements cause the perforation to be broken open completely or virtually completely.

Finally, the holding of the bag stack in a packer is assisted by a clamping plate provided below the plane of movement of the expanding elements of the expanding device, and an adapter used which has holding rods, at a distance from the interconnecting holes of the bag stack, and, with the interconnection of a transverse bracket, has fastening rods whose distance apart and diameter correspond to the dimensions of the limbs of a conventional wicket or receiving spikes of the packaging machine. The use of this adapter has the substantial advantage that the conventional packaging machine or automatic packaging machine, as was previously used for the insertion of wickets, hardly needs to be changed, if at all.

In addition, the use of an adapter gives the option of designing the lengths of the holding rods in such a manner that a plurality of comparatively large bag stacks can be stacked one above another, so that there is overall a noticeable increase in productivity during packing.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
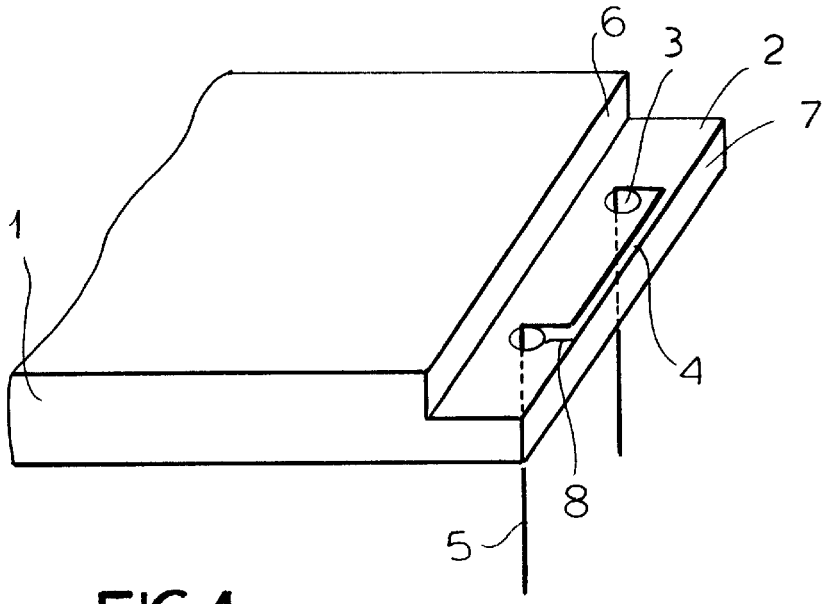
FIG.1 PRIOR ART
FIG. 1 is a perspective view which shows a bag stack forming part of the prior art and having a wicket.

According to FIG. 1 a bag stack 1 has, in a conventional manner, in the region of flap 2 stack openings 3 through which a wicket 4 is inserted. With the aid of the wicket and rubber stoppers (not illustrated) which are pushed onto its limbs 5, the bag stack can be held together reasonably well.

Each bag has a filling opening which is indicated by 6 and by which the bag can be filled with a product, for example a loaf of bread or the like, in a manner described further below in more detail. The flap 2 has an initial cutting point 8 in each case in the region between the stack openings 3 and a front edge 7 of the flap 2.

A bag stack 1 according to FIG. 1 is conventionally fitted with the wicket 4 in a collecting device, and together with said wicket and further auxiliary aids, such as the rubber stoppers, cover sheets, etc., is packaged in cartons and supplied for a filling operation.

With the aid of the wickets 4, the bag stack 1 is held in a packaging machine, for example and automatic packaging machine, in such a manner that with the assistance of air and/or suckers and an expanding device, the topmost bag in each case of the bag stack is brought into an opening position. The product to be inserted, for example a loaf of bread, is pushed via the filling opening 6 into the held-open bag with the aid of a slider (not illustrated), for example. The discharge force produced in this case causes the bag to start to tear along the initial cutting point 8 provided in the region of the stack opening, and so the bag comes free from the bag stack. Because the bag is torn off linearly, the flap 2 is unable to have a smooth front edge 7, i.e. the bag has an unsightly appearance because of the comparatively large punched-out stack holes and the rip locations.

Figure 2:
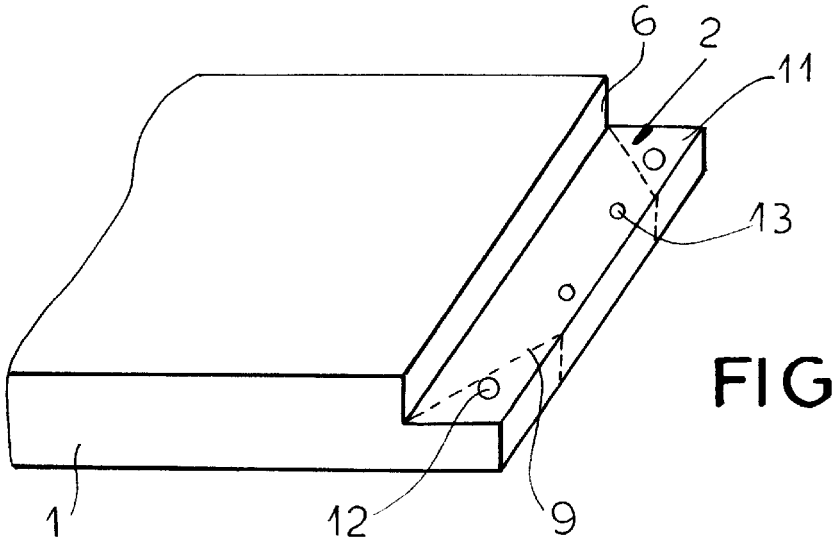
FIG. 2 is a perspective view which shows a bag stack consisting of bags according to FIG. 3.

FIG. 2 illustrates a first design of a bag stack which is formed according to the invention and has, in the region of the flap 2, corner sections 11 which are delimited by perforation lines 9 running obliquely with respect to the filling opening 6. The perforation lines 9 run continuously from the side edges of the bags as far as the front edge 7 of the flap 2. Located in the corner sections 11 are interconnecting points 12 which are used to hold together the bags, which consist of plastic film in the bag stack 1. The interconnecting points 12 are designed as interconnecting holes and thereby offer the option of suspending or holding the bag stack on a holding device (described further below in more detail) in the automatic packaging machine.

Figure 2A:
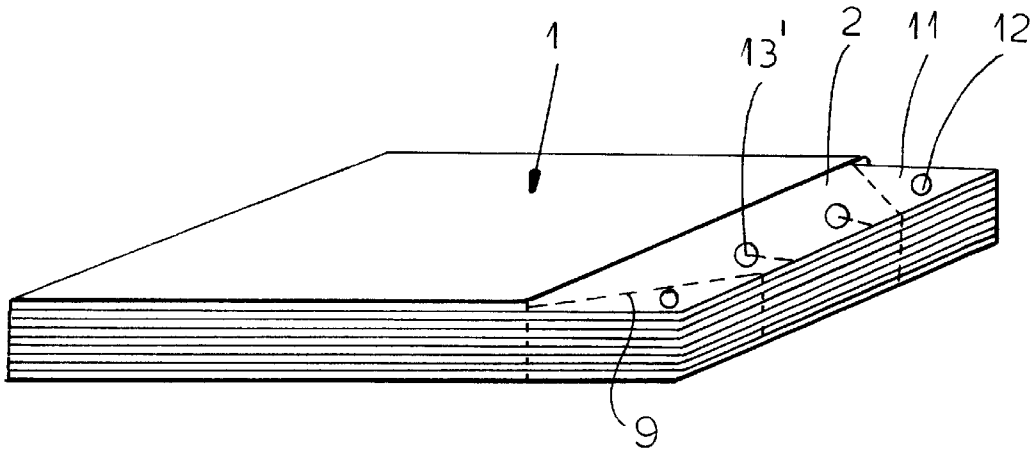
FIG. 2*a* is a perspective view corresponding to FIG. 2 of a bag stack consisting of bags according to FIG. 3*a;*

In order to collect the individual bags to form the bag stack 1 in a collecting device of an automatic bag-producing machine, use is made of stack openings 13 which are arranged in a central region, delimited by the perforation lines 9, of the flap 2 and are formed, for example according to FIG. 2, by pin holes. This means that the individual bags are speared on pins in the collecting apparatus and in this manner are initially held in the bag stack 1 in a positionally correct manner before they are interconnected. Instead of pin holes, the stack openings 13 may also be formed by cross recesses 13', for example, as is shown in FIGS. 2*a* and 3*a*.

Figure 3:
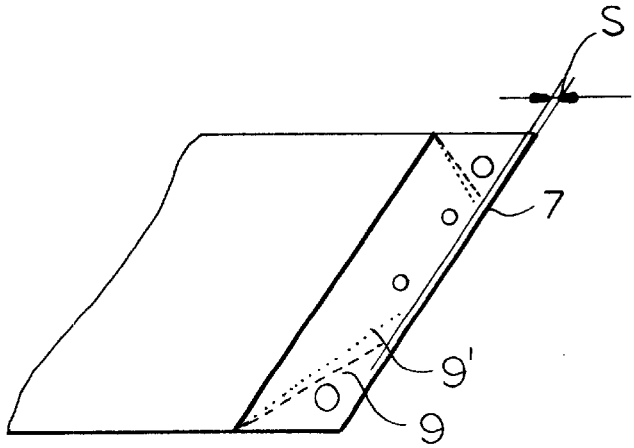
FIG. 3 is a perspective view which shows a first design of a bag.
Figure 3A:
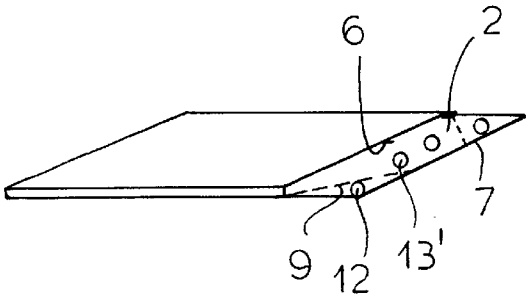
FIG. 3*a* is a perspective view of a modified design of a bag.

FIG. 3 illustrates, with reference to an individual bag of the bag stack according to FIG. 2, that the perforation line 9 is not implemented as far as the front edge 7 of the flap 2, but rather an unperforated part remains which is indicated in FIG. 3 by S. This distance S can be varied, depending on the discharge force in an automatic packaging machine. Finally, the angle of the perforation line 9 can also be varied—as indicated at 9'—and finally so can the perforation, strength. Owing to these possible changes of the corner perforation, it is possible —as is explained further below in greater detail—for a certain initial tearing behavior of the perforation lines 9 or 9' to be optimally determined.

Figure 4:
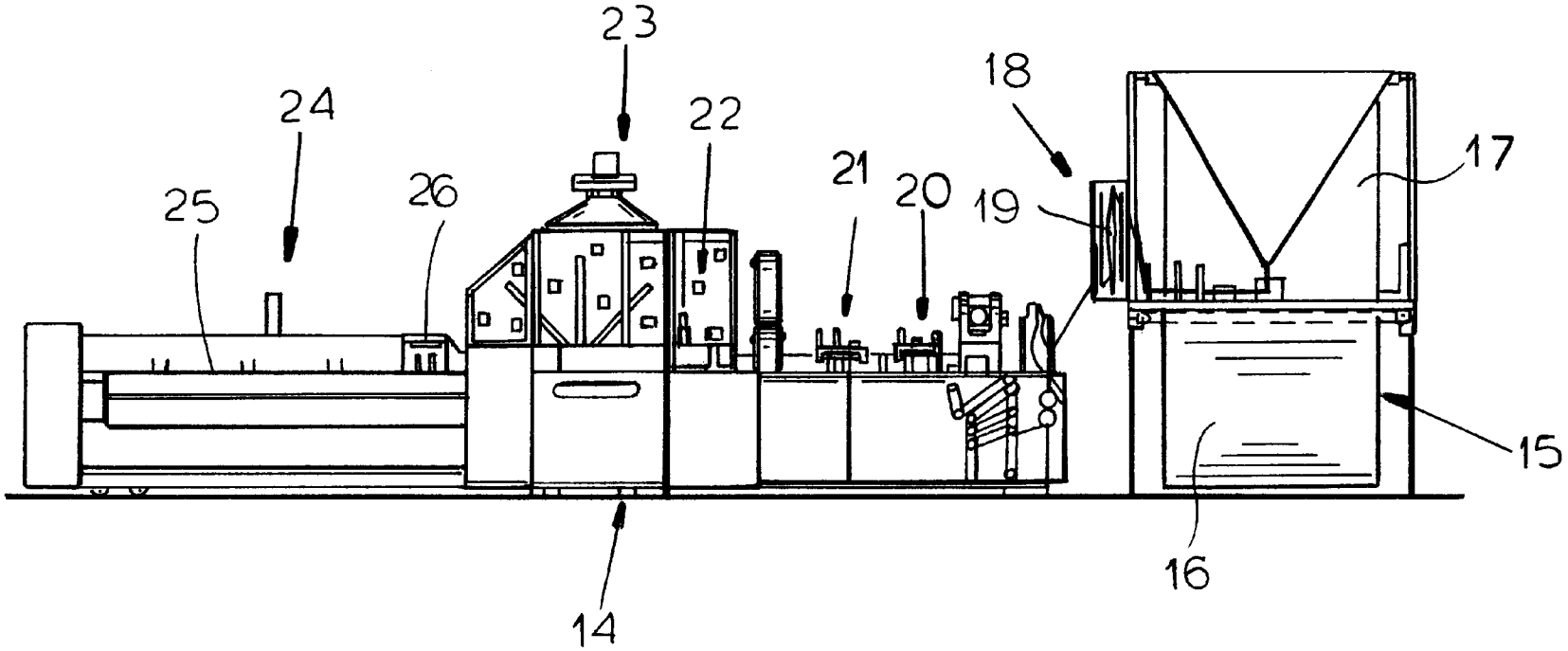
FIG. 4 is a schematic side view of a bag producing machine.

A bag-producing machine 14, which is illustrated in FIG. 4, is suitable for producing bags and bag stacks 1 according to the invention. The bag-producing machine includes a supply stand 15 having a winding roll 16 consisting of a thermoplastic film web. The latter may, for example, be designed as a flat film web 17. The flat film web 17 is guided within a processing stand 18 (only indicated schematically) via guiding rollers (not illustrated) which are accommodated in it, and also via a folding device and tension rollers. The processing stand 18 has a bottom fold inserting apparatus 19. A perforator 20 an d a cross-hole punching device 21 for making cross recesses 13', for example, are arranged behind the processing stand. The hole-punching device 21 is followed by a transverse-weld severing device 22 and a transfer device 23, which is finally adjoined by a stacking apparatus 24 having a stud-type stack conveying device 25. Finally, an interconnecting station 26 is arranged in the region of the stud-type stack conveying device 25. Said interconnecting station can be adjoined by an unloading station (not illustrated) for the interconnected bag stacks 1.

Figure 5:
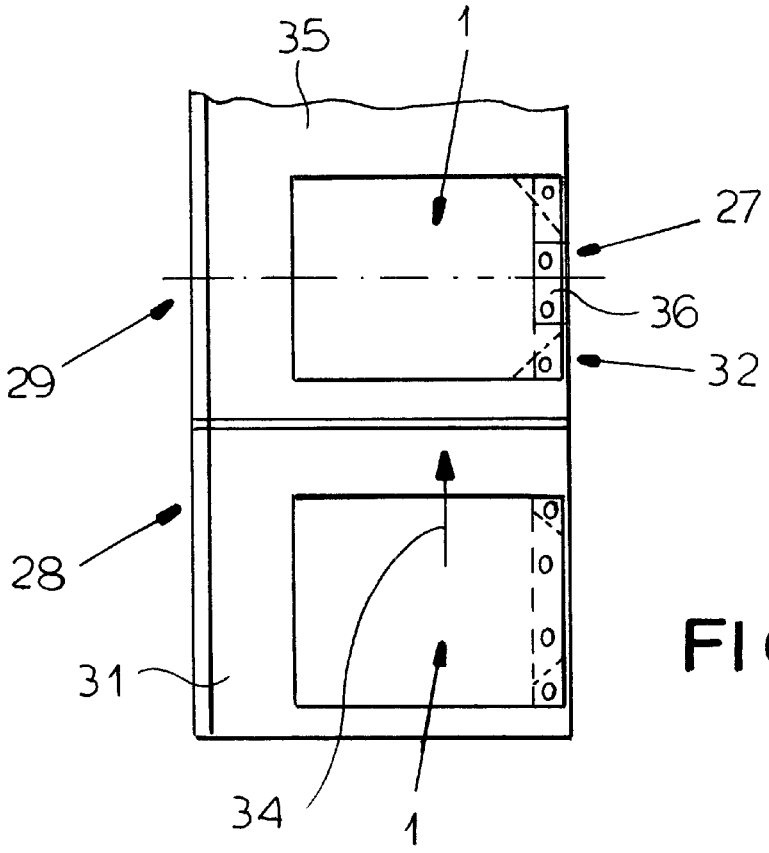
FIG. 5 is a plan view of a filling station with a preassembly station of a packaging machine (not illustrated in detail), for example an automatic packaging machine.

FIG. 5 illustrates part of an automatic packaging machine 27. The automatic packaging machine 27 has a preassembly station 28 which is mounted upstream of a filling station 29 (explained in more detail below) and serves to prepare bag stacks 1 for filling. In the preassembly station 28, one or more interconnected bag stacks 1, which lies or lie on a support surface 31, are held by a holding apparatus 32. The latter has a special adapter 33 which is described in more detail in conjunction with the filling procedure described below. The ready-prepared bag bundle is supplied to the filling station 29 in accordance with arrow 34, and is deposited there on a stacking table 35 which—as can be seen from FIG. 6—is designed such that it can be adjusted in height. In the filling position, the bag stack bears with the flap 2 of the topmost bag of the bag stack 1 against a stop plate 36 whose horizontal web 37 protrudes into the region of the flap 2 of the bags, while the other web 38, which preferably runs vertically to the web 37, of the clamping plate constitutes, for example, a stop for the front edge 7 of the bags.

Figure 6:
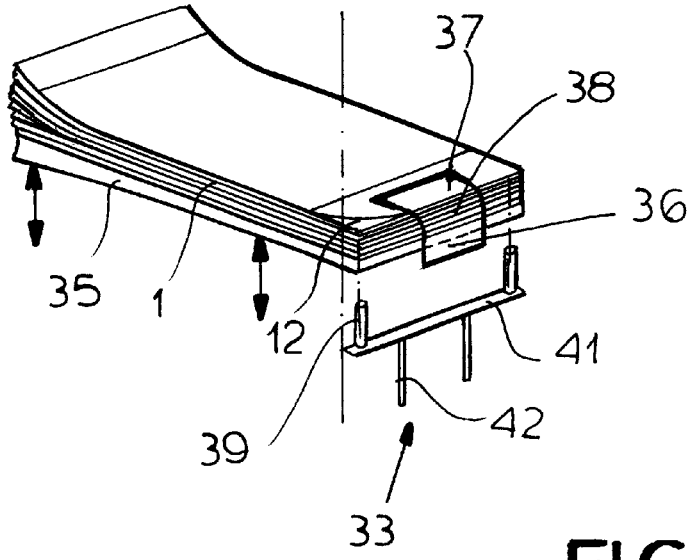
FIG. 6 is a perspective view of part of a packaging apparatus of the filling station.

For the sake of clarity, the adapter 33, which has already been mentioned above, is illustrated separately from the bag stack 1 in FIG. 6, although it is actually plugged in the interconnecting openings 12 of the bag stack 1 with holding rods 39. The adapter has a transverse bracket 41 which has fastening rods 42 arranged on its side facing away from the holding rods 39. The distance between, and diameter of, the two holding rods 42 correspond to the dimensions of a conventional wicket, as has hitherto been used in automatic packaging machines for filling vending machine bags.

Figure 7:
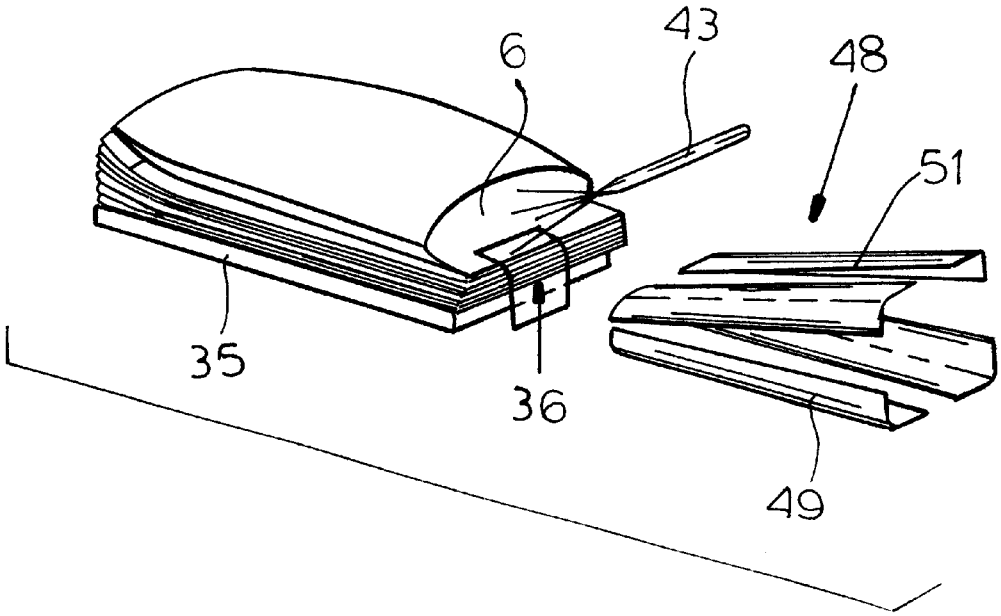
FIGS. 7 to 9 are perspective views of details of a packaging procedure.
Figure 8:
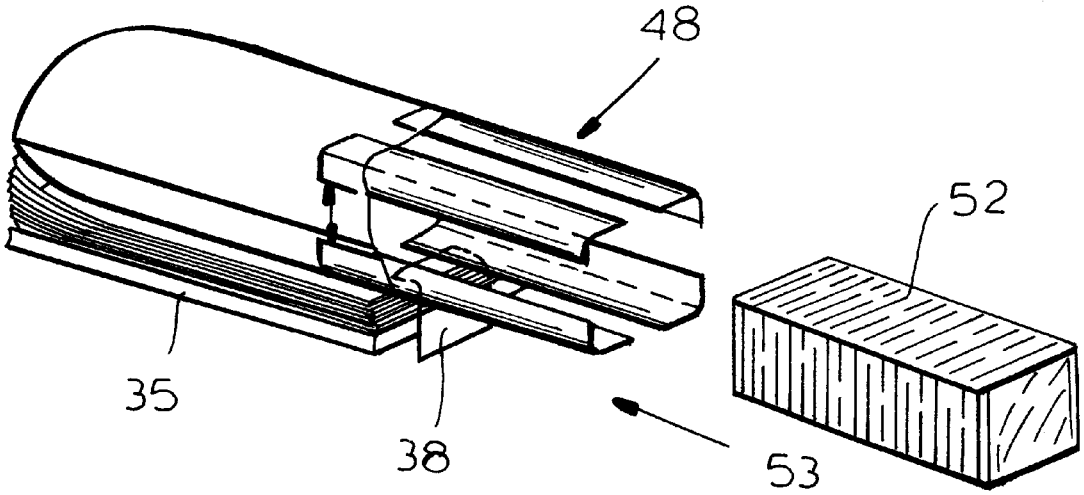
Figure 9:
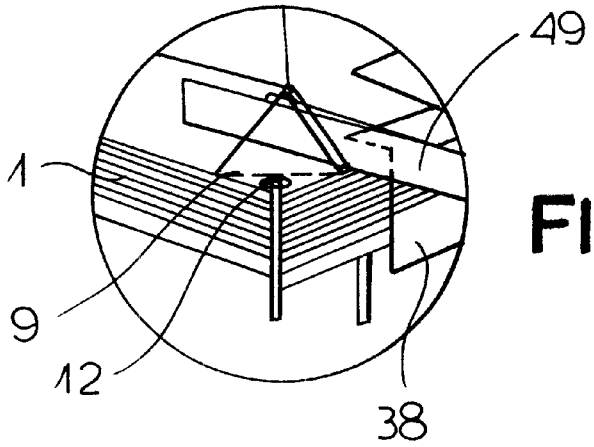
Figure 10:
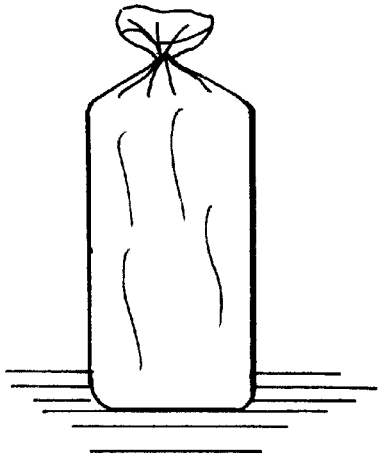
FIG. 10 is an elevational view of a ready-packaged bag.
Figure 11:
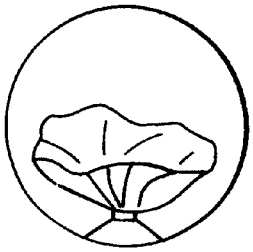
FIG. 11 is a detail in the sealing region of a packaged bag.

The actual filling procedure is explained in detail below with reference to FIGS. 7 to 9:

The automatic packaging machine includes, inter alia, an air-blowing device 43 (FIG. 7). Instead of blown air, a suction device may also be provided. Furthermore, an opening device having an expanding device 48 is provided which has lower expanding elements 49 and upper expanding elements 51 can be inserted into the preopened filling opening 6 of the topmost bag. Expansion of the bag at least in the region of the filling opening 6 causes the bag which is held open to be severed from the bag stack along the perforation lines 9 starting from the side edge of the bag (FIG. 9). The bag is held at the filling opening solely by the expanding elements of the expanding device and in the region of the flap 2 by the web 37 of the clamping plate 36. A product, for example a loaf of bread 52, is inserted through the opened expanding elements by means of a slider, indicated by the arrow 53, or a pair of tongs into the bag and the bag is then supplied together with the loaf of bread to a sealing device (not illustrated). FIG. 10 shows the ready packaged bread package and from FIGS. 10 and 11, it can be seen that the edge region of the bread bag seal no longer has frayed edges and the package therefore has a pleasing external appearance. As the height of the bag stack decreases, the stacking table 35 is moved up against the clamping plate 36.

Figure 12:
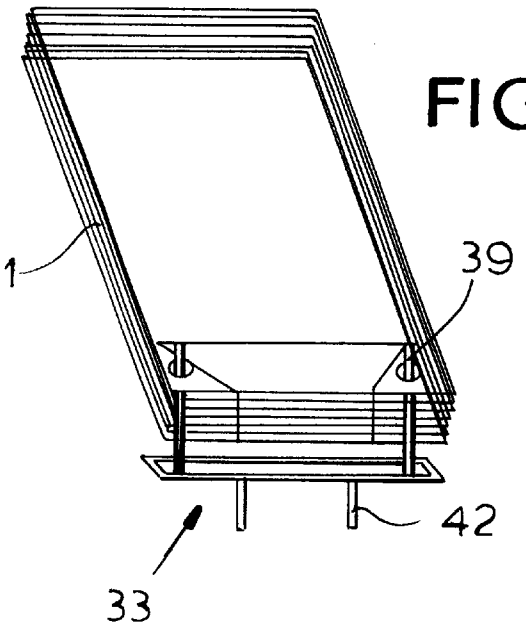
FIG. 12 is a diagrammatic perspective illustration of a bag stack with an adapter receiving said stack.
Figure 13:
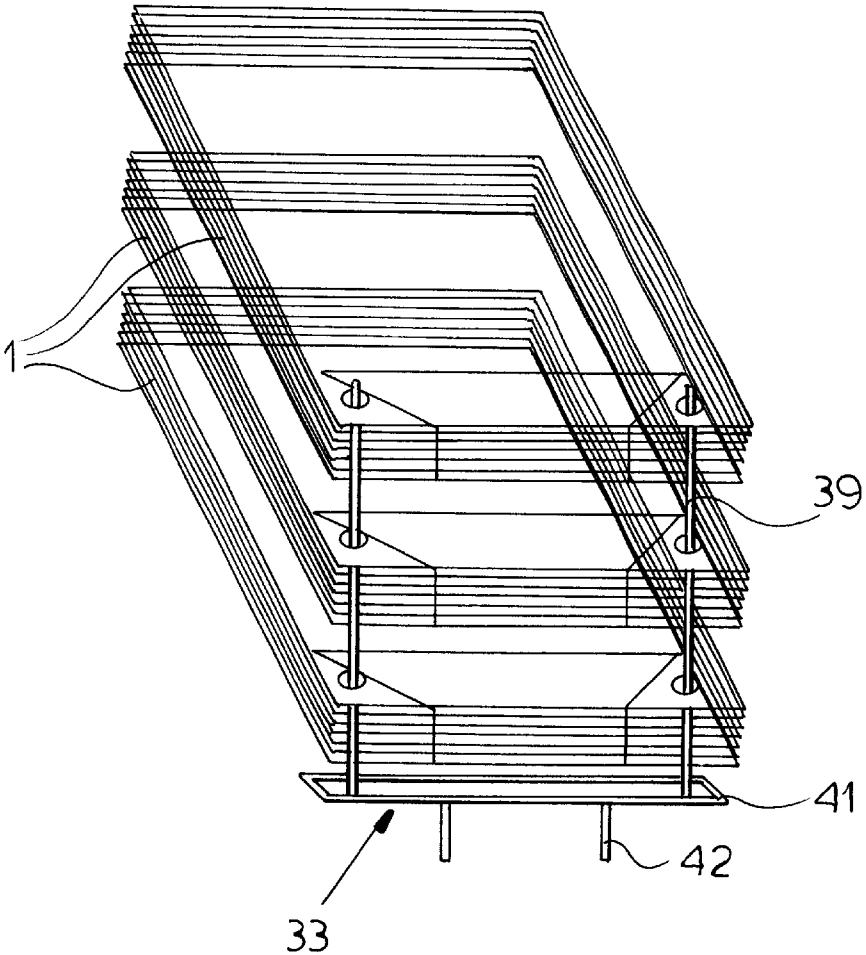
FIG. 13 is a diagrammatic perspective view of a modified design of the adapter with a plurality of bag stacks.

It can be seen from FIG. 12 that the holding rods 39 of the adapter 33 are substantially longer than the fastening rods 42. This provides the option of also receiving a plurality of bag stacks one above another on the adapter 33, as is shown by way of example in FIG. 13.

Depending on the size and weight, in the case of hygiene bags, instead of the wicket clamps fastening sleeves, preferably made of plastic material, are used per stack in order to bring the formed bag bundles securely and in a targeted manner into the packaging machine, in order to fill them there.

The bags or bag stacks designed according to the invention mean that it is possible for the fastening sleeves and their manual handling to be omitted. A plurality of bag stacks can likewise be inserted in the packaging machine one above another. As a result, the automatic packaging procedure is considerably less adversely affected than has previously been the case.

Instead of cross recesses, it is possible, for example, also for star-shaped recesses or the like to be punched in. The crucial factor is that no material waste occurs.

A clamping device or, for example, fixed supporting bolts of the automatic packaging machine are also conceivable as the securing device for the corner sections. The crucial factor is that during the opening procedure of the bag to be filled, it is ensured that the bag is held in a stretched manner, particularly in the region of the flap.

Figure 14:
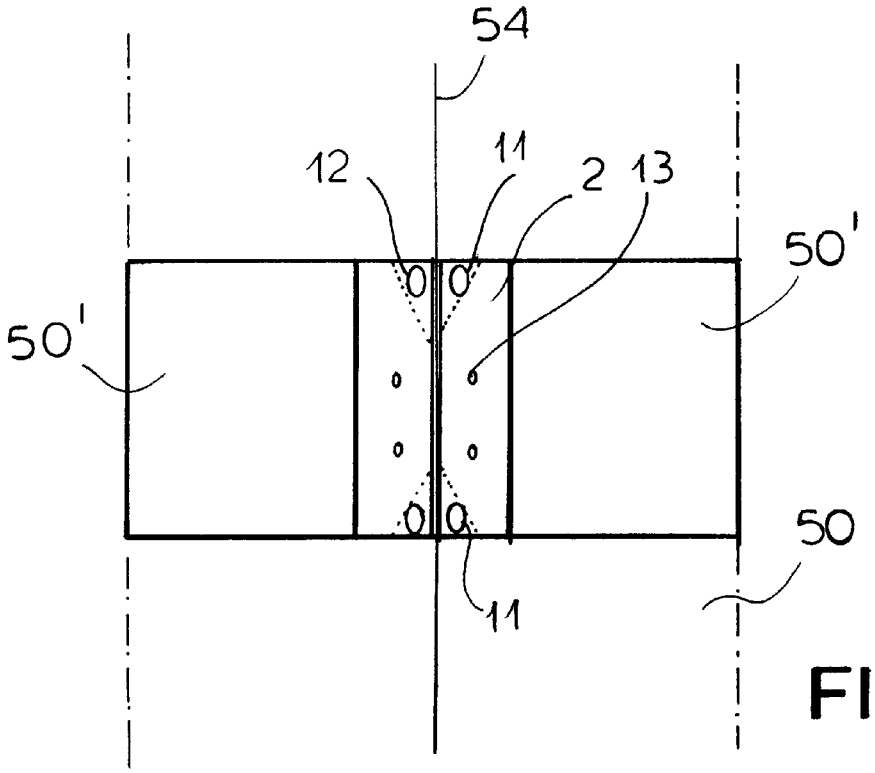
FIG. 14 is a plan view of a plastic film web for producing double-film web sections.

In each case, two opposite individual bags 50' are produced from a double-layered plastic film web 50, which is indicated in FIG. 14 by dash-dotted lines. For this purpose, a strip can be cut out of the one film layer symmetrically with respect to a central separating line 54, so that the flange-like flap 2 remains in the other film web. Alternatively, it is possible to cut open the, for example, tubular plastic film web in the longitudinal direction and guide the tubular film web in each case on both sides of the central separating line 54 in such a manner that the desired excess for the flap 2 likewise remains in the one film web.

Figure 15:
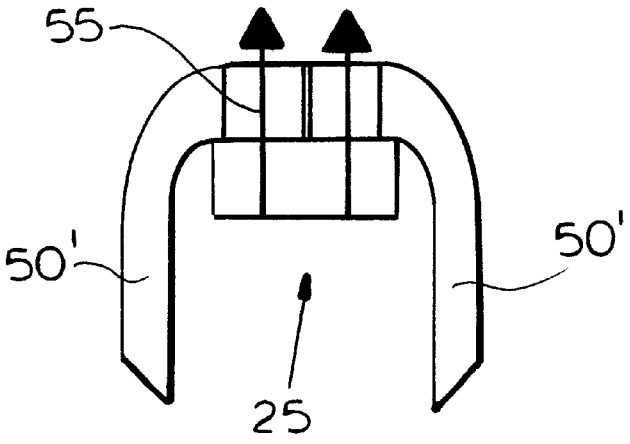
FIG. 15 shows a delivery device in the form of a stud-type stack conveying device with a double bag stack.

The individual bags, which are provided with the corner perforation sections 11 and are severed transversely from the web but are still joined together, are suspended stackwise via stack openings 13 which are produced in the flap 2 and are formed by pin holes of pins 55 of the stacking apparatus 24, which is indicated in FIG. 15 and is in the form of a stud-type stack conveying device 25. After that, the two opposite bag stacks 1 are interconnected via interconnecting points 12, after which the double bag stack is divided into two bag stacks 1 by a separating cut along the separating line 54. If the interconnecting points 12 are designed as interconnecting holes, the latter can be used as suspension openings for suspending the bag stacks in the automatic packaging machine.

What is claimed is:

1. A stack of plastic film bags in which a multiplicity of rectangular-outline plastic film bags are stacked one on top of another, each of said bags has a flap formed on one side of the respective bag extending from an edge of an opening of the respective bag to one side of the stack, said edges of said openings being parallel to but inward of said one side of the stack, said flaps being disposed one above another along said one side and having corner regions at opposite ends of said one side being delimited from a central region of the respective flap by perforation lines running inwardly at an inclination to the respective edge and said one side from opposite ends of the edge of the respective opening to an end of the respective flap, said flaps being formed with stacking openings in said central regions thereof enabling said bags to be stacked upon a respective member adapted to extend through said openings, and stack having respective hanger holes extending through said corner regions and at which said bags are bonded together, said hanger holes being capable of supporting said bags at said corner regions and said perforations being dimensioned and oriented to enable successive bags to be withdrawn from said stack linearly and to separate from said corner regions without fraying.

2. The stack as defined in claim 1 wherein said perforation lines run continuously from the respective edge of the respective opening of each bag to the end of the respective flap.

3. The stacking as defined in claim 1 wherein said openings are pin holes.

4. The stack defined in claim 1 wherein said openings are formed by cross slits.

* * * * *

UNITED STATES PATENT AND TRADEMARK OFFICE

CERTIFICATE OF CORRECTION

PATENT NO. : 6,508,588 B1
DATED : January 21, 2003
INVENTOR(S) : Armin Meyer et al.

It is certified that error appears in the above-identified patent and that said Letters Patent is hereby corrected as shown below:

Title page,
Item [73], should read -- LEMO Maschinenbau GmbH --

Signed and Sealed this

Tenth Day of June, 2003

JAMES E. ROGAN
*Director of the United States Patent and Trademark Office*